US008080757B2

(12) United States Patent
Zuo

(10) Patent No.: US 8,080,757 B2
(45) Date of Patent: Dec. 20, 2011

(54) SLIDING BUTTON MECHANISM AND PORTABLE ELECTRONIC DEVICE USING THE SAME

(75) Inventor: Zhou-Quan Zuo, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 210 days.

(21) Appl. No.: 12/534,287

(22) Filed: Aug. 3, 2009

(65) Prior Publication Data

US 2010/0072041 A1 Mar. 25, 2010

(30) Foreign Application Priority Data

Sep. 19, 2008 (CN) ..... 2008 1 0304581

(51) Int. Cl.
*H01H 15/02* (2006.01)

(52) U.S. Cl. ..... 200/548

(58) Field of Classification Search ..... 200/547–550
See application file for complete search history.

(56) References Cited

U.S. PATENT DOCUMENTS

| | | | | |
|---|---|---|---|---|
| 5,122,627 | A * | 6/1992 | Trana | 200/548 |
| 6,333,479 | B1 * | 12/2001 | Tai | 200/550 |
| 7,208,692 | B2 * | 4/2007 | Yamaguchi | 200/547 |
| 2004/0240162 | A1 * | 12/2004 | Hsu et al. | 361/680 |
| 2007/0215450 | A1 * | 9/2007 | Sun | 200/550 |
| 2008/0060929 | A1 * | 3/2008 | Iijima | 200/547 |
| 2010/0155215 | A1 * | 6/2010 | Zuo | 200/550 |

* cited by examiner

*Primary Examiner* — Vanessa Girardi
(74) *Attorney, Agent, or Firm* — Altis Law Group, Inc.

(57) ABSTRACT

A sliding button mechanism includes a housing defining an aperture, a button slidably mounted on the housing and closing the aperture; a conductive and elastic connector member secured on the button; and a circuit board secured in the housing and including a plurality of contact areas. The connector member is positioned between the button and the circuit board. When the button is slid in the aperture, the connector member is driven to selectively contacts with the contact areas to generate different electronic connections.

14 Claims, 7 Drawing Sheets

SLIDING BUTTON MECHANISM AND PORTABLE ELECTRONIC DEVICE USING THE SAME

BACKGROUND

1. Technical Field

The present disclosure relates to sliding button mechanisms, and particularly to a sliding button mechanism for portable electronic devices and a portable electronic device using the same.

2. Description of Related Art

With the development of technology, many portable electronic devices (e.g., mobile phones and personal digital assistants) are designed to be multifunctional. For example, a mobile phone can also have the functions of capturing photos, receiving broadcasts and surfing the internet, etc. In use, these multifunctional portable electronic devices can be switched into different working modes corresponding to these functions.

Sliding button mechanisms are widely used in the multifunctional portable electronic devices to switch working modes thereof. A sliding button mechanism usually includes at least one slidable button mounted on a housing of a portable electronic device and connected to slidable electronic connectors. When the button slides to different positions, different circuits corresponding to different working modes can be switched on by the connectors, thus the portable electronic device can be used in corresponding functions.

In many conventional sliding button mechanisms, the buttons are usually not in tight contact with the housings to allow for easy sliding. Thus, portable electronic devices employing these sliding button mechanisms have assembling gaps formed between their housings and the buttons, which unfortunately may allow contaminants to enter the device and cause problems.

Therefore, there is room for improvement within the art.

BRIEF DESCRIPTION OF THE DRAWINGS

Many aspects of the present sliding button mechanism and portable electronic device using the same can be better understood with reference to the following drawings. The components in the various drawings are not necessarily drawn to scale, the emphasis instead being placed upon clearly illustrating the principles of the present sliding button mechanism and portable electronic device using the same. Moreover, in the drawings, like reference numerals designate corresponding parts throughout the figures.

DETAILED DESCRIPTION

Figure 1:
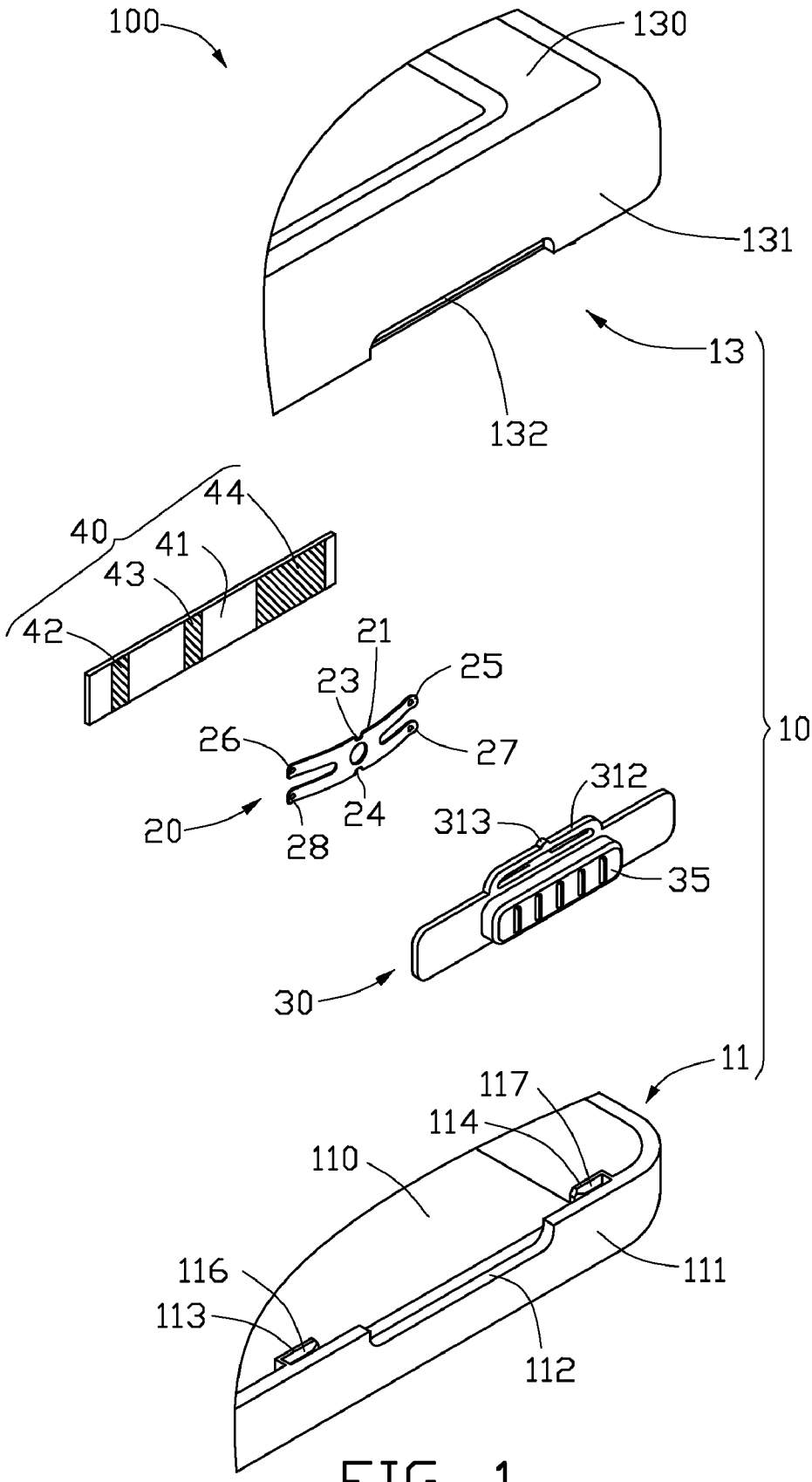
FIG. 1 is a schematic, disassembled view of a sliding button mechanism, according to an exemplary embodiment.
Figure 2:
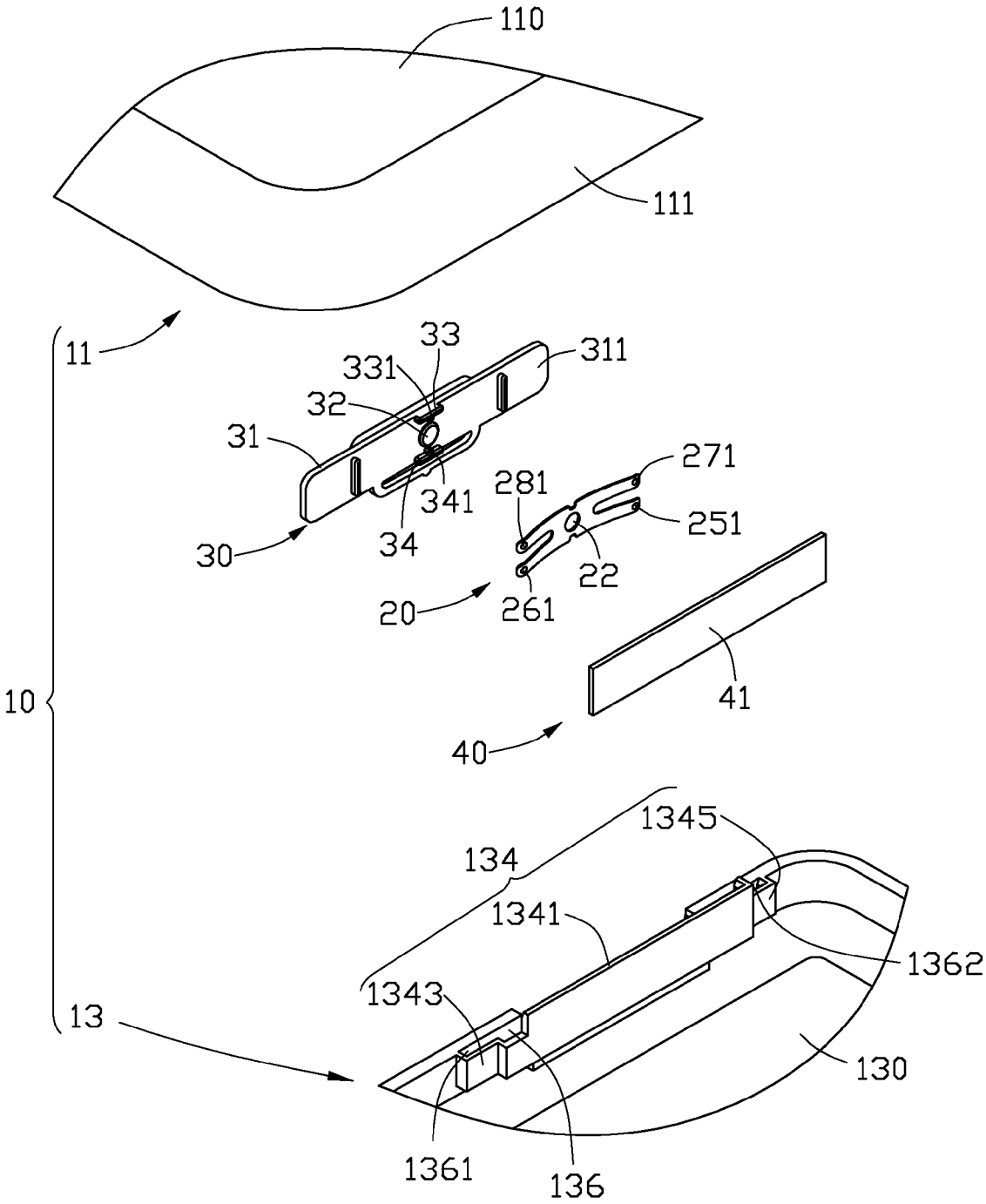
FIG. 2 is similar to FIG. 1, but shown in another view angle.

FIG. 1 and FIG. 2 schematically show a sliding button mechanism 100 according to an exemplary embodiment, which is used in a portable electronic device (not labeled) such as a mobile phone or a personal digital assistant. The sliding button mechanism 100 can be operated to switch on different circuits of the portable electronic device, thereby switching the portable electronic device to different corresponding working modes. The sliding button mechanism 100 may include a housing 10, a connector member 20, and a button 30.

Figure 3:
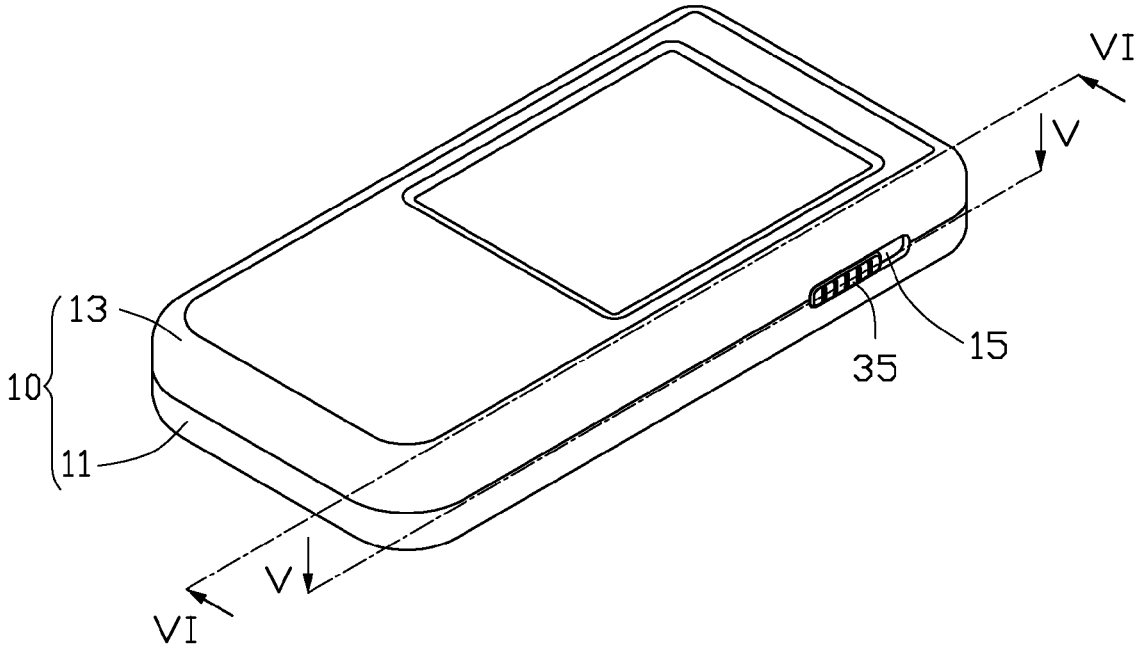
FIG. 3 is a schematic view of assembling the sliding button mechanism shown in FIG. 1 to a portable electronic device, according to a first working mode.
Figure 4:
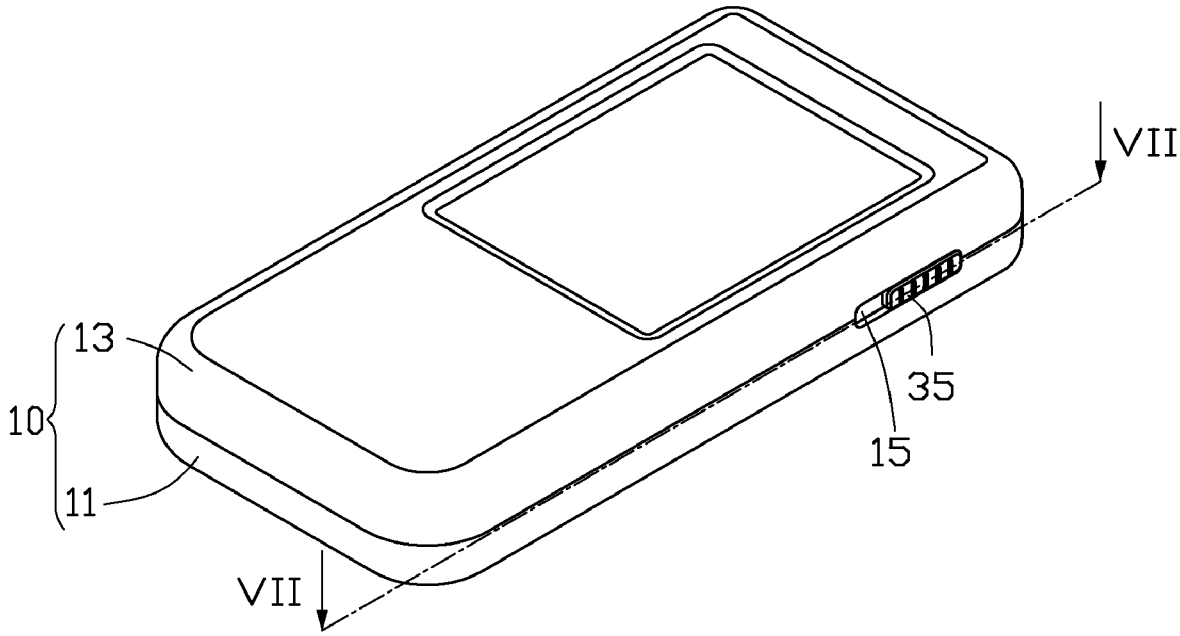
FIG. 4 is similar to FIG. 3, but showing the sliding button mechanism in a second working mode.

Also referring to FIG. 3 and FIG. 4, the housing 10 can be a part of a housing of the portable electronic device, which includes a first case 11 and a second case 13. The first case 11 includes a first case board 110 and a first frame 111, wherein the first case board 110 is a planar sheet, and the first frame 111 is a frame perpendicularly connected to a side of the first case board 110 to surround the first case board 110. A first assembling gap 112 is defined in a side of the first frame 111. Two retaining members 113, 114 are formed on the first frame 111. The retaining members 113, 114 are L-shaped boards. Each of the two retaining members 113, 114 has one end perpendicularly connected to an inner surface of the side of the first frame 111 defining the first assembling gap 112 and another end extending parallel to the side of the first frame 111. The extending ends of the two retaining members 113, 114 extend towards each other. The first assembling gap 112 is positioned between the two retaining members 113, 114. Two retaining spaces 116, 117 are respectively formed between the retaining members 113/114 and the first frame 111.

The second case 13 includes a second case board 130 and a second frame 131, wherein the second case board 130 is a planar sheet, and the second frame 131 is a frame perpendicularly connected to a side of the second case board 130 to surround the second case board 130. A second assembling gap 132 corresponding to the first assembling gap 112 is defined in a side of the second frame 131. When the first case 11 is assembled together with the second case 13, the first assembling gap 112 cooperates with the second assembling gap 132 to form a longitudinal aperture 15.

Figure 6:
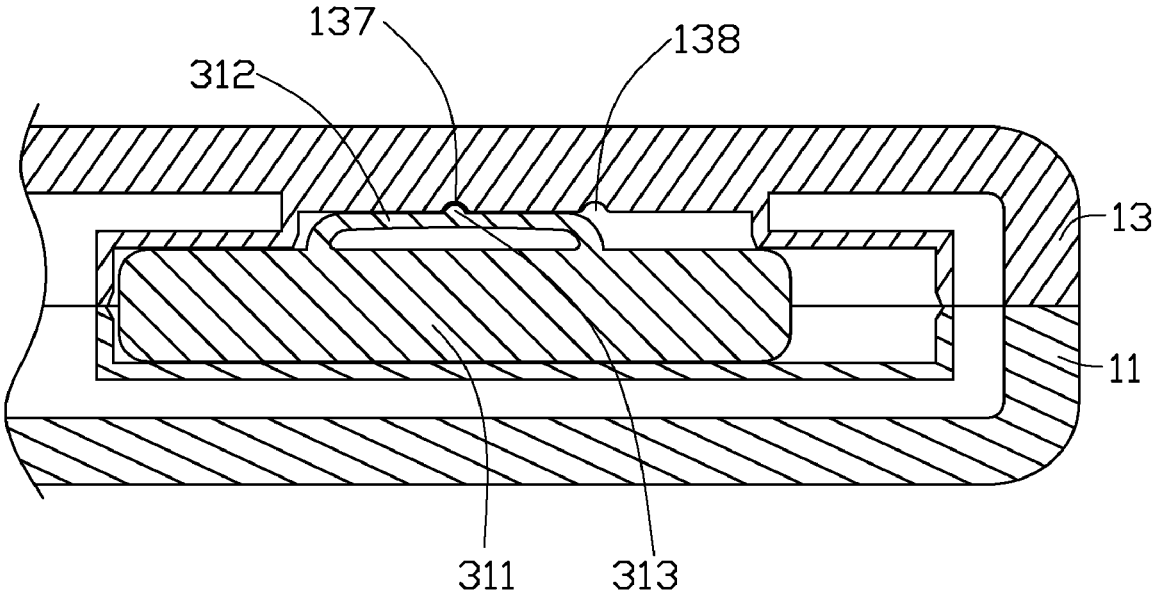
FIG. 6 is a cut-away view along the line VI-VI shown in FIG. 3.

A holding member 134 is mounted on an inner surface of the second frame 131. The holding member 134 includes a holding panel 1341 and two connecting members 1343, 1345. The holding panel 1341 is a planar board connected to an inner surface of the second frame 131. Particularly, the holding panel 1341 is positioned parallel to the side of the second frame 131 defining the second assembling gap 132 and aligned with the second assembling gap 132. The two connecting members 1343, 1345 are L-shaped boards corresponding to the retaining members 113, 114. Each of the two connecting members 1343, 1345 has one end perpendicularly connected to an inner surface of the side of the second frame 131 defining the second assembling gap 132 and another end extending parallel to the side of the second frame 131. The extending ends of the two connecting members 1343, 1345 extend towards each other. The second assembling gap 132 is positioned between the two connecting members 1343, 1345. A receiving space 136 is formed between the holding panel 1341 and the second frame 131, and two cooperating spaces 1361, 1362 (i.e., similar to the retaining spaces 116, 117) communicating with the receiving space 136 are respectively formed between the connecting members 1343, 1345 and the second frame 131. Also referring to FIG. 6, two separate adjusting gaps 137, 138 are defined in portions of the second frame 131 corresponding to the receiving space 136.

The connector member 20 is made of conductive elastic materials. The connector member 20 includes a main board 21. An assembling hole 22 is defined in a central portion of the main board 21, and two holding gaps 23, 24 are respectively defined in two opposite sides of the main board 21. Four corners of the main board 21 extend to form four elastic arms 25, 26, 27, 28, wherein the arms 25, 26 are positioned collinear, the arms 27, 28 are positioned collinear, and the arms 25, 26 are parallel to the arms 27, 28. The arms 25, 26, 27, 28 are all bent to a same side of the main board 21, thereby the connector member 20 being arc-shaped. Four contact protrusions 251, 261, 271, 281 are formed on the distal ends of the arms 25, 26, 27, 28, correspondingly.

The button 30 includes a main body 31, which corresponds in shape and size to the holding panel 1341. The thickness of the main body 31 is less than the thicknesses of the retaining spaces 116, 117 and the cooperating spaces 137, 138, and the length of the main body 31 is less than that of the receiving space 136 and larger than that of the first assembling gap 112 and the second assembling gap 132. Thus, the main body 31 can be received in and slide in the receiving space 136, without falling out. A bar-shaped adjusting portion 312 is connected to the main body 31. The adjusting portion 312 is positioned parallel to a side edge of the main body 31 and aligned with a middle portion of the main body 31, and two ends of the adjusting portion 312 are connected to the main body 31. An elastic adjusting protrusion 313 corresponding to the adjusting gaps 137, 138 is formed on a middle portion of the adjusting portion 312.

An assembling pole 32 corresponding to the assembling hole 22 is perpendicularly connected to a central portion of the main body 31. Two flanges 33, 34 are formed on two sides of the main body 31. The flanges 33, 34 are two parallel bar-shaped protrusions perpendicularly connected to the main body 31 and extending along two relatively longer sides of the main body 31, respectively. The assembling pole 32 is positioned between the flanges 33, 34. Two holding protrusions 341, 342 are respectively formed on the central portions of the flanges 33, 34 and both extend towards the assembling pole 32. The shapes and sizes of the holding protrusions 341, 342 respectively correspond to that of the holding gaps 23, 24. An operating portion 35 is formed on a surface of the main body 31 opposite to the assembling hole 32 and the flanges 33, 34. The operating portion 35 is a board having ribs on its surface, and the length of the operating portion 35 is less than that of the first assembling gap 112 and the second assembling gap 132. Thus, the operating portion 35 can be received in and slide in the first assembling gap 112 and the second assembling gap 132.

A PCB 40, which is a part of the inner circuits of the portable electronic device, can cooperate with the sliding button mechanism 100 to selectively switch on different working modes of the portable electronic device. The PCB 40 includes a main board 41 having a shape and a size corresponding to the holding panel 1341. A first contact area 42, a second contact area 43, and a third contact area 44 are separately formed on a surface of the main board 41. The first contact area 42, the second contact area 43, and the third contact area 44 are conductive layers used as electronic connectors.

Also referring to FIGS. 3-6, in assembly, the PCB 40 is received and secured in the receiving space 136, with the first contact area 42, the second contact area 43 and the third contact area 44 positioned toward the second assembling gap 132. The assembling pole 32 is inserted into the assembling hole 22, and the holding protrusions 331, 341 respectively engage with the holding gaps 23, 24, thus the connector member 20 is mounted to the button 30. The button 30 with the connector member 20 mounted thereon is then inserted into the receiving space 136, with the connector member 20 positioned inwards, i.e., towards the PCB 40. Two ends of the main body 31 are partially received the cooperating spaces 1361, 1362 respectively. The operating portion 35 is exposed out of the first assembling gap 112. The adjusting portion 312 is positioned towards the second case board 130. The contacting protrusions 251, 261, 271, 281 are pressed to be in contact with the PCB 40. Thus, the button 30 and the connector member 20 are slidably mounted on the second case 13, and the main body 31 is positioned parallel to the holding panel 1341 and the PCB 40 and is pressed to be in contact with the inner surface of the second frame 131 by the rebounding elastic arms 25, 26, 27, 28. When the operating portion 35 is pushed along the second assembling gap 132 to drive the button 30 to slide, the adjusting protrusion 313 can selectively engage with the adjusting gaps 137, 138, thereby holding the connector member 20 in predetermined positions to respectively switch different circuits.

Figure 5:
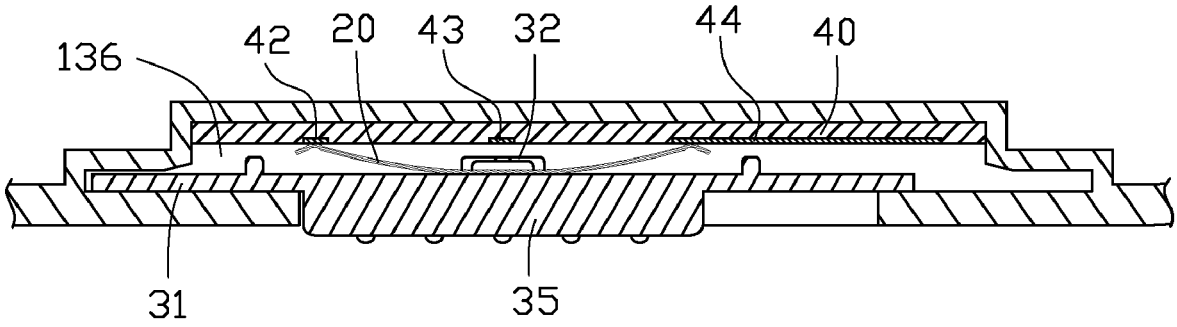
FIG. 5 is a cut-away view along the line V-V shown in FIG. 3.
Figure 7:
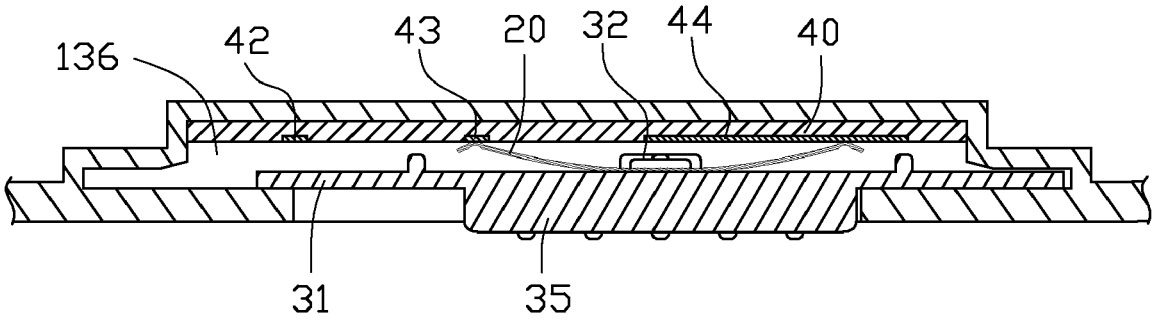
FIG. 7 is a cut-away view along the line VII-VII shown in FIG. 4.

In the present embodiment, the positions of the adjusting gaps 137, 138 are disposed to correspond to the connecting areas 41, 42, 43 of the PCB 40. Particularly, when the adjusting protrusion 313 engages with the first adjusting gap 137, the connecting protrusions 25, 27 contact the third contact area 44 and the connecting protrusions 26, 28 contact the first contact area 42 to generate a first electronic connection, as shown in FIG. 5; when the adjusting protrusion 313 engages with the second adjusting gap 138, the connecting protrusions 25, 27 contact the third contact area 44 and the connecting protrusions 26, 28 contact the second contact area 43 to generate a second electronic connection, as shown in FIG. 7.

The first case 11 is then assembled together with the second case 13, thereby forming the housing 10. The first assembling gap 112 is aligned with the second assembling gap 132 and cooperates with the second assembling gap 132 to form the longitudinal aperture 15, and the operating portion 35 exposes out of the aperture 15. The holding panel 1341 is also aligned with the aperture 15. The retaining members 113, 114 are respectively aligned with the connecting members 1343, 1345, and the cooperating spaces 1361, 1362 cooperate with the retaining spaces 116, 117 to receive the two ends of the main body 31. Thus, the main body 31 can also be pressed to be in contact with the inner surface of the first frame 121 by the rebounding elastic arms 25, 26, 27, 28. The first contact area 42, the second contact area 43, and the third contact area 44 are respectively electronically connected to corresponding circuits (not shown) of the portable electronic device.

In use, the exposed operating portion 35 is pushed to slide along the aperture 15. Thus, the button 30 and the connector member 20 are driven to slide relative to the PCB 40. As above described, when the adjusting protrusion 313 is slide to engage with the adjusting gap 137/138, the sliding connector 20 can selectively form a first electronic connection between the first contact area 42 and the third contact area 44 or a second electronic connection between the second contact area 43 and the third contact area 44. The first electronic connection and the second electronic connection can be respectively used to switch on different working modes of the portable electronic device. Thus, the sliding button mechanism 100 can easily switch the portable electronic device to different corresponding working modes.

Since the holding panel 1343 is pressed to be in contact with the inner surface of the housing 10 by the rebounding connector member 20, the aperture 15 can be kept closed by the main body 31 to prevent contaminants entering the portable electronic device. The elastic connector member 20 can also facilitate the sliding operation of the button 30.

Understandably, the PCB 40 can further include more than three contact areas, such that more than two electronic connections can be selectively generated when the connector member 20 slides relative to the PCB 40. Correspondingly, the second frame 131 can define more than two adjusting gaps for cooperating with the adjusting protrusion 313 to hold the connector member 20 at predetermined positions to keep the electronic connections. Thus, the portable electronic device can be switched to more than two working modes corresponding to the electronic connections by operation on the sliding button mechanism 100.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A sliding button mechanism of a portable electronic device, comprising:

a housing including a first case and a second case assembled together, the first case defining a first assembling gap, the second case defining a second assembling gap corresponding to the first assembling gap, the first assembling gap being aligned with the second assembling gap to form an aperture; the first case further including two retaining members and the second case further including two connecting members, the two retaining members corresponding to the two connecting members and respectively aligned with the two connecting members;

a button slidably mounted on the housing and closing the aperture, the button including a main body slidably received in the housing; when the button is slid, the two retaining members and the two connecting members cooperatively limiting the main body at predetermined positions; and a conductive and elastic connector member secured on the button, wherein the connector member is driven to selectively contact different contact areas of a circuit board of the portable electronic device and generate different electronic connections as the button is slid in the aperture.

2. The sliding button mechanism as claimed in claim 1, wherein the housing further includes a holding panel positioned parallel to the main body and aligned with the aperture, and the circuit board is secured on the holding panel.

3. The sliding button mechanism as claimed in claim 2, wherein the two connecting members connect the holding panel to the housing.

4. The sliding button mechanism as claimed in claim 1, wherein the button further includes an operating portion exposed out of the aperture to be slid by the user.

5. The sliding button mechanism as claimed in claim 4, wherein the button further includes an adjusting portion formed thereon, and the housing defines a plurality of adjusting gaps cooperating with the adjusting portion to hold the button at predetermined positions to keep the electronic connections.

6. The sliding button mechanism as claimed in claim 5, wherein the adjusting portion includes an elastic adjusting protrusion formed thereon for engaging with the adjusting gaps to hold the button at predetermined positions to keep the electronic connections when the button is slid.

7. The sliding button mechanism as claimed in claim 4, wherein the connector member includes a main board secured on the main body and a plurality of elastic arms connected to the main board, the elastic arms contacting the contact areas of the circuit board to generate the electronic connections.

8. The sliding button mechanism as claimed in claim 7, wherein the elastic arms rebound to press the main body to be in contact with an inner surface of the housing for closing the aperture.

9. A portable electronic device, comprising:

a housing including a first case and a second case assembled together, the first case defining a first assembling gap, the second case defining a second assembling gap corresponding to the first assembling gap, the first assembling gap being aligned with the second assembling gap to form an aperture; the first case further including two retaining members and the second case further including a holding member formed therein, the holding member including a holding panel aligned with the aperture and two connecting members connecting the holding panel to the second case, the two retaining members corresponding to the two connecting members and respectively aligned with the two connecting members;

a button slidably mounted on the housing and closing the aperture, the button including a main body slidably received in the housing and positioned parallel to the holding panel; when the button is slid, the two retaining members and the two connecting members cooperatively limiting the main body at predetermined positions;

a conductive and elastic connector member secured on the button; and a circuit board secured on the holding panel and including a plurality of contact areas, wherein the connector member is positioned between the button and the circuit board and is driven to selectively contact the contact areas and generate different electronic connections as the button is slid in the aperture.

10. The portable electronic device as claimed in claim 9, wherein the button further includes an operating portion exposed out of the aperture to be slid by the user.

11. The portable electronic device as claimed in claim 10, wherein the button further includes an adjusting portion formed thereon, and the second case defines a plurality of adjusting gaps cooperating with the adjusting portion to hold the button at predetermined positions to keep the electronic connections.

12. The portable electronic device as claimed in claim 11, wherein the adjusting portion includes an elastic adjusting protrusion formed thereon for engaging with the adjusting gaps to hold the button at predetermined positions to keep the electronic connections when the button is slid.

13. The portable electronic device as claimed in claim 10, wherein the connector member includes a main board secured on the main body and a plurality of elastic arms connected to the main board, the elastic arms contacting the contact areas of the circuit board to generate the electronic connections.

14. The portable electronic device as claimed in claim 13, wherein the elastic arms rebound to press the main body to be in contact with an inner surface of the housing for closing the aperture.

* * * * *